US006745663B2

(12) United States Patent
Ebersole et al.

(10) Patent No.: US 6,745,663 B2
(45) **Date of Patent: *Jun. 8, 2004**

(54) APPARATUS FOR MITIGATING RECOIL AND METHOD THEREOF

(75) Inventors: Harvey N. Ebersole, Columbus, OH (US); Paul T. Ratajczak, Bellefontaine, OH (US); James F. Mank, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 31 days.

This patent is subject to a terminal disclaimer.

(21) Appl. No.: 10/376,516

(22) Filed: Feb. 28, 2003

(65) Prior Publication Data

US 2003/0154851 A1 Aug. 21, 2003

Related U.S. Application Data

(63) Continuation-in-part of application No. 09/942,409, filed on Aug. 28, 2001, now Pat. No. 6,578,464.

(51) Int. Cl.[7] ..... F41A 25/00

(52) U.S. Cl. ..... 89/42.01; 89/177; 42/1.06

(58) Field of Search ..... 89/42.01, 177; 42/1.06

(56) References Cited

U.S. PATENT DOCUMENTS

| | | | | |
|---|---|---|---|---|
| 3,866,724 | A | 2/1975 | Hollnagel | |
| 3,951,238 | A | 4/1976 | Dent et al. | |
| 4,498,517 | A | 2/1985 | Mase | |
| 4,514,921 | A | 5/1985 | Burkleca | |
| 4,656,921 | A * | 4/1987 | Zierler | 89/43.01 |
| 4,709,758 | A | 12/1987 | Preston, Jr. | |
| 4,842,234 | A | 6/1989 | Koch | |
| 4,875,402 | A * | 10/1989 | Metz | 89/43.01 |
| 4,924,751 | A * | 5/1990 | Metz et al. | 89/43.01 |
| 4,972,760 | A | 11/1990 | McDonnell | |
| 5,180,037 | A | 1/1993 | Evans | |
| 5,215,170 | A | 6/1993 | Rapa | |
| 5,309,817 | A | 5/1994 | Sims | |
| 5,328,180 | A | 7/1994 | Benavides et al. | |
| 5,353,681 | A * | 10/1994 | Sugg | 89/43.01 |
| 5,617,664 | A * | 4/1997 | Troncoso | 42/1.06 |
| 5,652,406 | A | 7/1997 | Phan | |
| 5,794,703 | A | 8/1998 | Newman et al. | |
| 6,062,350 | A | 5/2000 | Spieldiener et al. | |
| 6,325,148 | B1 | 12/2001 | Trahan et al. | |
| 6,347,505 | B2 | 2/2002 | Scheufeld | |
| 6,578,464 | B2 * | 6/2003 | Ebersole, Jr. et al. | 89/42.01 |

OTHER PUBLICATIONS

National Institute of Justice Final Report; Law Enforcement Robot Technology Assessment; 4.0 Validating & Prioritizing User Needs; Aug. 23, 2001; pp 1–14.

Mini De Armer Disruptor Recoilless Stand Off; RE 9–9; RE 6.1–12; Richmond EEI Limited; Armtec Estate, North Lopham, Norfolk IP22 2LR, England.

Midi De Armer Disruptor Recoilless Stand Off; RE 12–12/28; Richmond EEI LTD.; Armtec Estate, North Lopham, Norfolk IP22 2LR, England.

Maxi De Armer Disruptor Recoilless Stand Off; RE 70 M3; Richmond EEI Limited; Armtec Estate, North Lopham, Norfolk, IP22 2LR, England.

Proparms History Products Contacts News; Proparms Limited Products; Feb. 21, 2000; http://www.proparms.com/index.htm.

* cited by examiner

*Primary Examiner*—J. Woodrow Eldred
(74) *Attorney, Agent, or Firm*—William B. Richards

(57) ABSTRACT

A recoil-mitigated projectile-firing device comprising a firing assembly, the firing assembly comprising the projectile-firing device secured within a tube and the recoil-mitigated projectile-firing device further comprising a brake assembly surrounding a portion of the tube. The brake assembly comprising at least one brake shoe supported within a frame and means for urging the at least one brake shoe against the outer surface of the tube. When the projectile-firing device is discharged, the firing assembly moves relative to the brake assembly and the frictional force mitigates the recoil.

33 Claims, 7 Drawing Sheets

APPARATUS FOR MITIGATING RECOIL AND METHOD THEREOF

This application is a continuation-in-part of, and claims priority to, U.S. application Ser. No. 09/942,409, filed Aug. 29, 2001, entitled "Recoil Mitigation Device", now U.S. Pat. No. 6,578,464, the disclosure of which is incorporated as if fully rewritten herein.

This invention was made with Government support under Contract No. N41756-02-C-4695 awarded by the Combating Terrorism Technology Support Office, Technical Support Working Group. The Government has certain rights in this invention.

FIELD OF THE INVENTION

This invention relates to an apparatus for mitigating the recoil of projectile-firing devices and methods thereof. More particularly, the present invention relates to utilizing friction for mitigating the recoil of projectile-firing devices designed to disarm explosives devices, commonly known in the art as an explosives disrupters. Even more particularly, the present invention relates to using friction for mitigating the recoil of projectile-firing devices attached to remote-control robots or robot arms, often used by law enforcement agencies and others for remotely disarming explosives devices.

BACKGROUND OF THE INVENTION

In any gun system, or more generally, projectile-firing device, conservation of momentum provides that the momentum carried by the projectile and the gases is equal to, but in the opposite direction of, the momentum imparted to the device. The momentum imparted to the device is, in turn, equal to the recoil force integrated over time, or the impulse. This is commonly referred to as the "kick" experienced when a device is fired. While the total amount of momentum for a given projectile fired at a given velocity cannot be changed, it can be managed. The force-time profile can be changed from a very high, short-lived force, to a longer, much lower amplitude force pulse.

Present recoil-mitigation devices utilize complex and expensive hydraulics, pneumatics, pistons, springs, friction, or some combination thereof. In addition, present devices are integral to the projectile-firing device and, therefore, not always easily or quickly adaptable to varying situations. Examples include U.S. Pat. Nos. 4,514,921 (coil spring compression), 4,656,921 (hydraulic fluid), 4,972,760 (adjustable recoil spring), 5,353,681 (recoil spring, friction, and pneumatics), and 5,617,664 (recoil spring).

In the particular case of some explosives disrupters, there may be no recoil mitigation. Disrupter devices are typically attached to a support frame mounted on the ground or mounted on a remote-controlled robot, whereby the device can be triggered from a relatively safe distance to fire a projectile into an article suspected of containing a bomb or other explosives. Such devices are generally of a single-shot design and produce a significant impulse—oftentimes sufficient to propel the support frame/robot backwards, cause it to topple over, and/or sustain significant damage. Depending upon the situation, such devices may be called upon to fire a variety of projectiles at a variety of velocities from a variety of support frame/robots. This in turn creates a variety of recoil forces requiring, in turn, a variety of recoil mitigation solutions tailored to each support frame/robot. For example, the momentum imparted to devices from a column of water, often used to disarm soft-package bombs, such as briefcase bombs, may vary from close to five pounds-force-seconds at a low velocity to over nine pounds-force-seconds at a high velocity (140 milliliter load at a velocity of 1,000 feet per second) and even as high as 12 pounds-force-seconds. It has been demonstrated that the recoil forces resulting from firing a high velocity water load reach as high as 15,000 pounds-force. Metal slugs impart momentum in the range of four pounds-force-seconds to six pounds-force-seconds.

A general rule of thumb for a device without recoil mitigation fired by a human is that the momentum should not exceed three pounds-force-seconds. By comparison, the momentum carried by a 150 grain projectile fired from a 30–06 rifle at a velocity of 2,810 feet per second is approximately 1.87 pounds-force-seconds. Thus, the momentum generated by an explosives disrupter can be relatively significant.

It is also important that the recoil system not appreciably affect the performance of the disrupter or its projectiles. Procedures have been developed over the years that allow users to successfully disrupt a variety of suspected bombs, and a recoil system that forces users to adjust techniques is not desirable.

Therefore, there is a need for a recoil-mitigation device which overcomes these disadvantages.

BRIEF DESCRIPTION OF THE INVENTION

According to the present invention, a recoil mitigation apparatus and method is provided. The apparatus includes a brake assembly, comprising at least one brake shoe, adapted to enable frictional braking force to be imposed, directly or indirectly, upon a projectile-firing device, such that when the device is fired, the friction created mitigates the recoil of the device. In a preferred embodiment, the projectile-firing device is secured within a tube to form a firing assembly. The firing assembly is placed within the brake assembly, the at least one brake shoe of the brake assembly frictionally contacting the tube with force supplied by a spring-loaded clamp or similar device. The brake assembly is further restrained, for example, by a remote-control robot or robot arm, such that when the firing device is fired, the firing assembly frictionally recoils but is slideably restrained by the brake assembly, whereby the recoil force is mitigated. Although a tube is preferred, to at least protect the projectile-firing device, those skilled in the art will recognize that the projectile-firing device may be placed directly within the brake assembly and the frictional contact be applied directly to the projectile-firing device itself; for example, to the barrel.

Accordingly, an object of the present invention is to provide a friction brake recoil mitigation apparatus that is readily adapted to a variety of supports, projectile-firing devices, projectiles, and projectile velocities for mitigating the recoil of such devices when the device is fired. Further objects, advantages, and novel aspects of the present invention will become apparent from a consideration of the drawings and subsequent detailed description.

BRIEF DESCRIPTION OF THE DRAWINGS

The subsequent detailed description particularly refers to the accompanying figures in which.

DETAILED DESCRIPTION OF THE INVENTION AND BEST MODE

Figure 1:
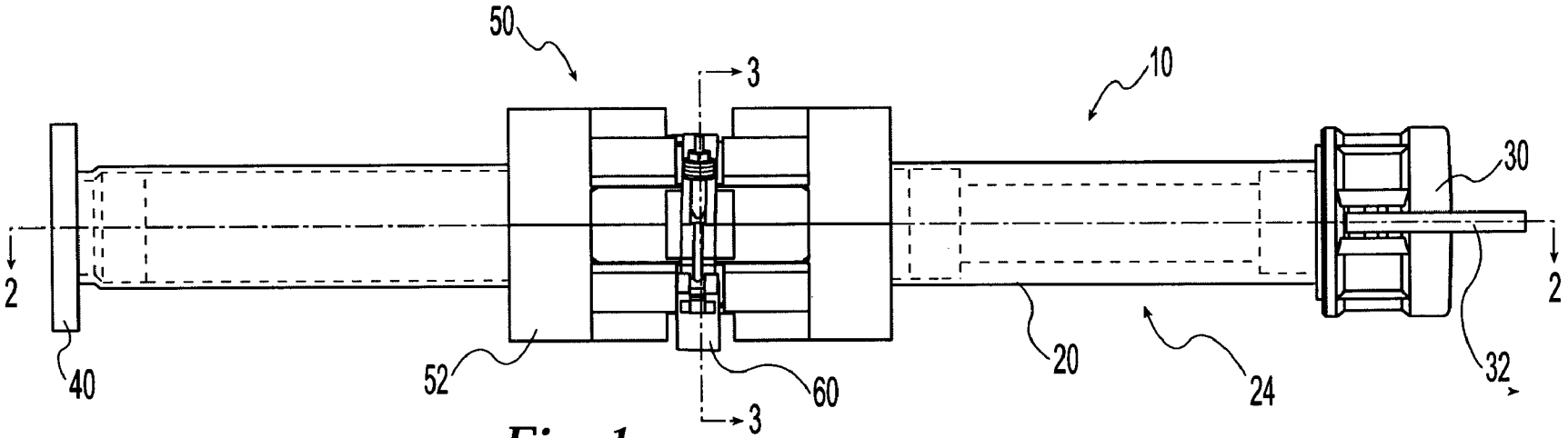
FIG. 1 is an elevation view of the recoil-mitigated projectile firing device.
Figure 2:
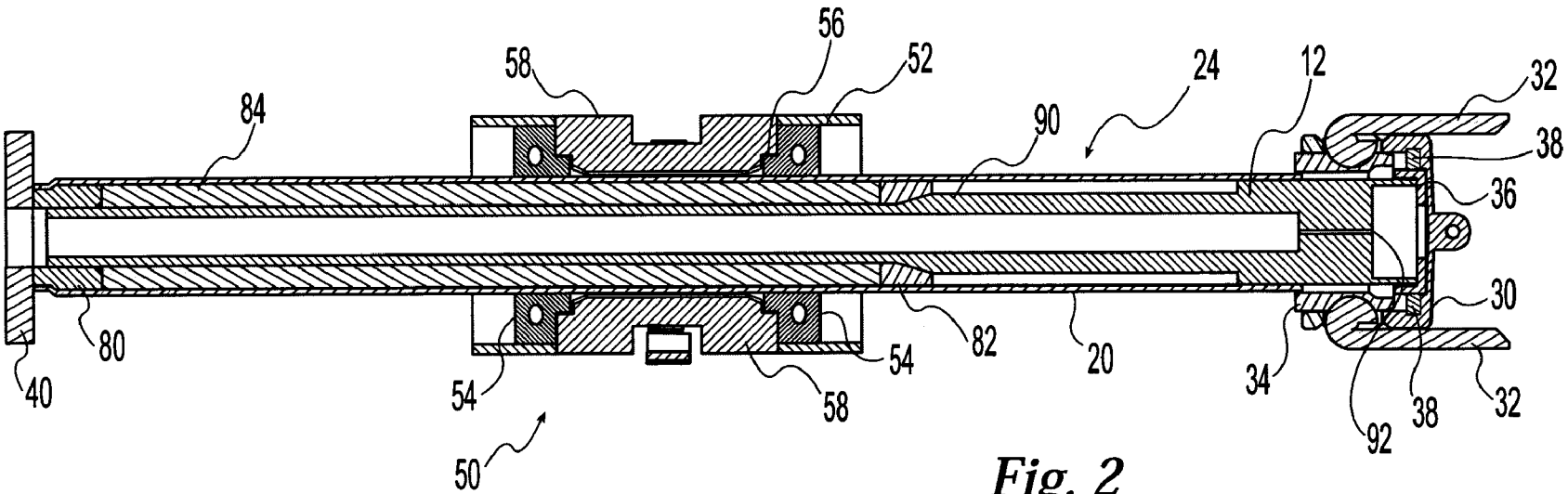
FIG. 2 is a lateral section view of the recoil-mitigated projectile-firing device taken along the line 2—2 of FIG. 1.
Figure 3:
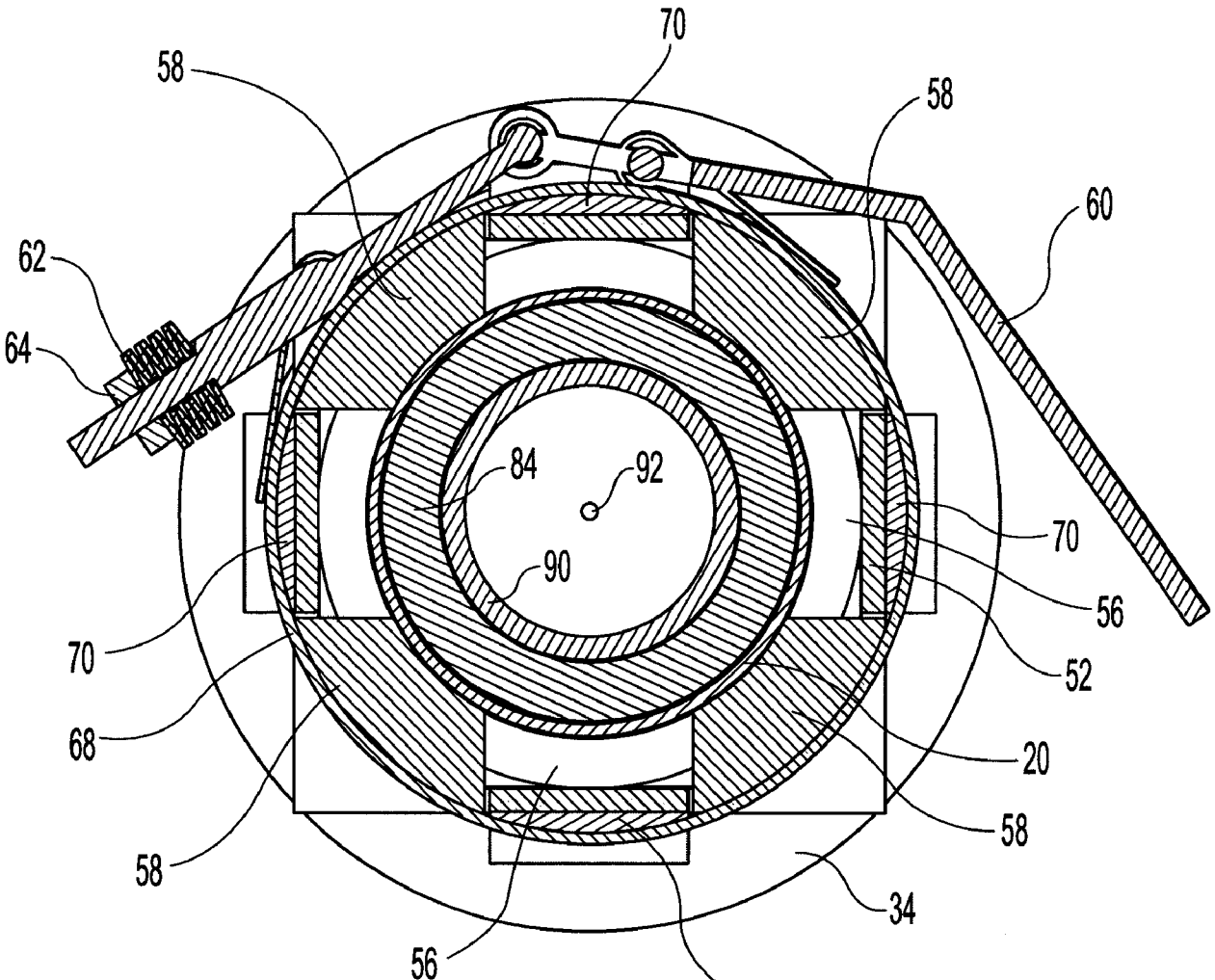
FIG. 3 is a cross-sectional view of the recoil-mitigated projectile-firing device taken along the line 3—3 of FIG. 1.
Figure 7:
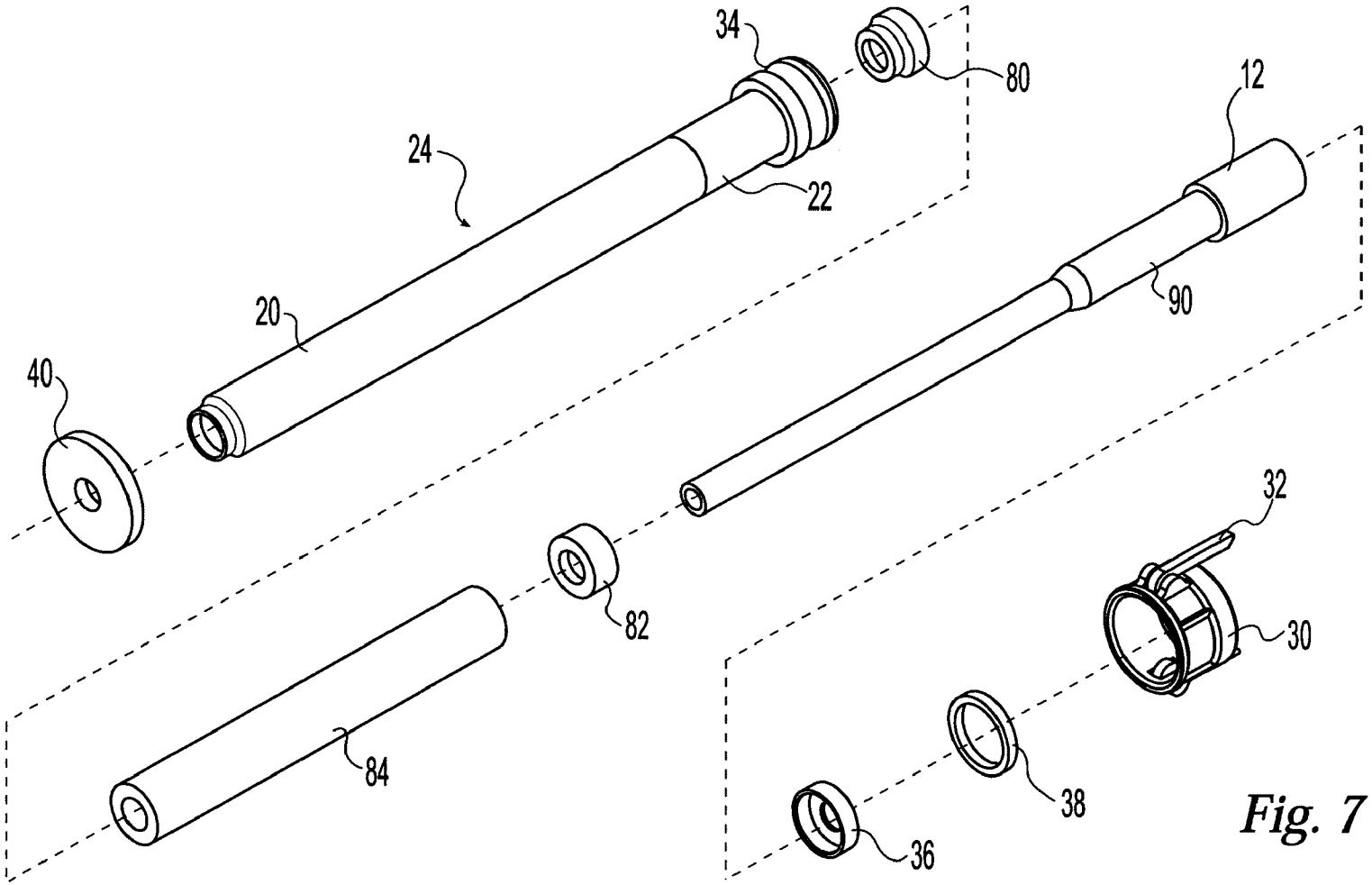
FIG. 7 is an exploded view of the firing assembly according to the present invention.

An elevation view of a recoil-mitigated projectile-firing device 10 according to the present invention is shown in FIG. 1. A projectile-firing device 90 (best shown in FIG. 2) represents a commercially-available projectile-firing device. More specifically, an explosives disrupter such as a PAN (Percussion Actuated Non-electric) disrupter, distributed by Ideal Products, Lexington, Ky. under the trademark PAN DISRUPTER under license from Sandia National Laboratories, Albuquerque, N. Mex., a Lockheed Martin company, may be used. Other manufacturers of similar devices include Royal Arms International, Woodland Hills, Calif. Such devices also typically include a breech 12 enclosing a firing mechanism (not shown) and means for firing the device (not shown). The breech 12 also includes a lead-through hole 92 (FIG. 2) for shock tubing (not shown) or similar material for firing the projectile-firing device 90. As best shown in FIGS. 2 and 7, a firing assembly 24 is provided. The projectile-firing device 90 receives a first bushing 82, preferably formed out of acetal, to help provide support between the device 90 and a tube 20 and to help position a support sleeve 84. The tube 20 provides a relatively inexpensive protective cover for the relatively expensive projectile-firing device 90. As will be appreciated by those skilled in the art, the cross-section of the projectile-firing device 90 need not be circular, and, in fact, could be, for example, hexagonal. Likewise, the cross-section of the tube 20 need not be circular, and in fact, could be, for example, hexagonal. A second bushing 80, preferably formed out of aluminum, further helps position the support sleeve 84 and provide additional support between the device 90 and the tube 20. Both the first bushing 82 and the second bushing 80 could also be formed of ceramic, wood, paper, or practically any rigid material. The sleeve 84 may be formed out of a wide variety of materials. Preferably, the sleeve 84 acts as a spring between the first bushing 82 and the second bushing 80 to urge the projectile-firing device 90 against an end closure 30 or interposed cushion 36. A preferred material for the sleeve 84 is polyethylene foam used for pipe insulation because of its light weight, resiliency, and ready availability. Other items, such as a metal coil spring or pneumatic sleeve could also be used. As will be appreciated by those skilled in the art, other methods and supports may be employed within the spirit and scope of the present invention.

The assembled projectile-firing device 90, the first bushing 82, the second bushing 80, and the sleeve 84 are positioned within the tube 20. An end closure adapter 34 is secured to one end of the tube 20 and optionally an end stop 40 is secured to the other end of the tube 20. The end stop 40 provides a way of arresting the travel of the firing assembly 24 should the brake assembly 50 fail to properly do so. The cushion 36 is preferably interposed between the end closure 30 and the projectile-firing device 90 and is centered with a gasket 38. End closure arms 32 secure the entire firing assembly 24. As will be appreciated by those skilled in the art, the cushion 36 may be required to absorb significant forces. Brass is preferred, but lead would also work well. A strong, ductile material is preferred to spread the force of the recoil of the projectile-firing device 90 across a larger area of the end closure 30.

While a firing assembly 24 is shown, other like assemblies will be appreciated by those skilled in the art. Most prominently, the projectile-firing device 90 alone may be employed without the other components of the firing assembly 24. While advantages may accrue to the firing assembly 24, the application of frictional force, either directly to the projectile-firing device 90, or indirectly via a tube 20 or other like elements can suffice to mitigate the recoil. Furthermore, the firing assembly 24, while shown as numerous separate elements, may be constructed of fewer, but more integrated, components.

Figure 4:
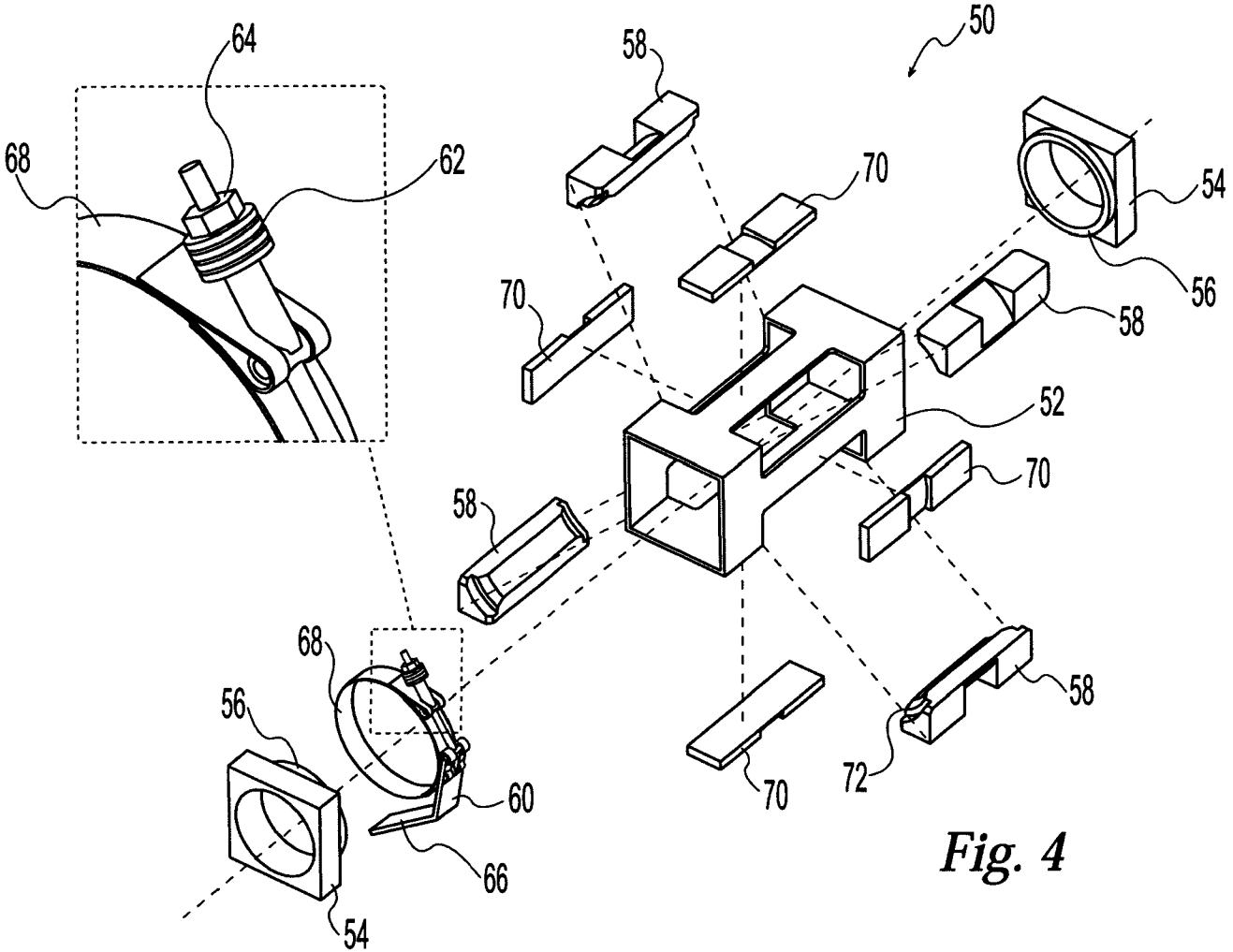
FIG. 4 is an exploded view of the brake assembly.
Figure 6:
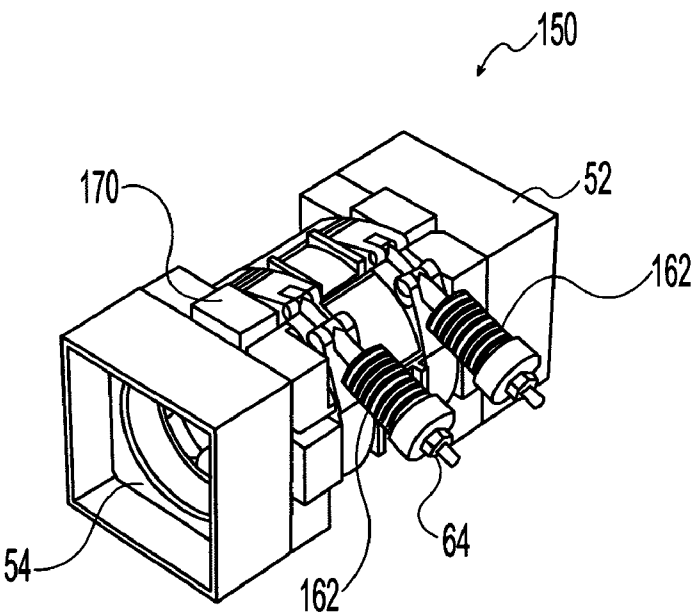
FIG. 6 is a perspective view of the brake assembly according to a further embodiment of the present invention.
Figure 5:
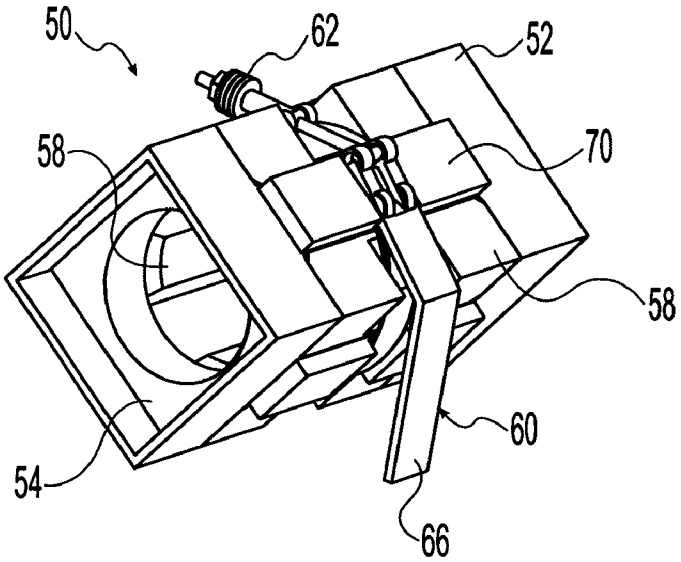
FIG. 5 is a perspective view of the brake assembly according to an embodiment of the present invention.

As shown in FIGS. 1–6, 8A, and 8B, a brake assembly 50 provides the means for mitigating the recoil of the firing assembly 24. As best shown in FIG. 4, the brake assembly 50 comprises a frame 52 to help support and cooperate with the other components of the brake assembly 50. In a best mode, the frame 52 is constructed of aluminum and comprises a plurality of openings for receiving a plurality of brake shoes 58. The brake shoes 58 may be formed of a wide variety of materials. For example, metallics such as leaded or aluminum bronzes or cast iron may be used. Resin-bonded inorganics, such as woven materials, or, preferably, molded solids are preferred as their coefficients of friction are more stable with variations in the ambient environment such as humidity and liquid moisture. Additional structure is provided to support a plurality of clamp guides 70 which cooperate with the clamp strap 68 to help align the clamp 60. One or more guide bushings 54 are provided for cooperating with and receiving the firing assembly 24. In a best mode, each guide bushing 54 comprises a shoulder 56 for restrainingly contacting brake shoe chamfer 72, thus helping to restrain each brake shoe 58 and keep it from falling inward when the tube 20 is not in place. As will be appreciated, however, the cooperation between the chamfer 72 and the shoulder 56 must allow the brake shoe 58 to sufficiently frictionally contact the outer surface of the tube 20 to provide the necessary frictional braking force. As with the firing assembly 24, the brake assembly 50 may be constructed of fewer, but more integrated, components. One or more clamps 60 are provided for securing the brake assembly 50 and for urging the brake shoes 58 against the tube 20, thus providing the necessary friction to mitigate the recoil of the projectile-firing device 90. As will be appreciated by those skilled in the art, the one or more clamps 60 may be chosen to provide the force required for the desired friction between the brake shoes 58 and the tube 20. The tube 20 provides a larger circumference than the projectile-firing device 90, thus providing greater area for contact with the brake shoes 58. As shown in the inset of FIG. 4, the force provided by the clamp 60 may be controlled by the inclusion of compression means such as disc springs 62 or coil springs 162. (Shown in FIG. 6.) For securing the compression means 62 or 162, simple nuts or, for reproducibility, a jam nut may also be utilized.

Figure 10:
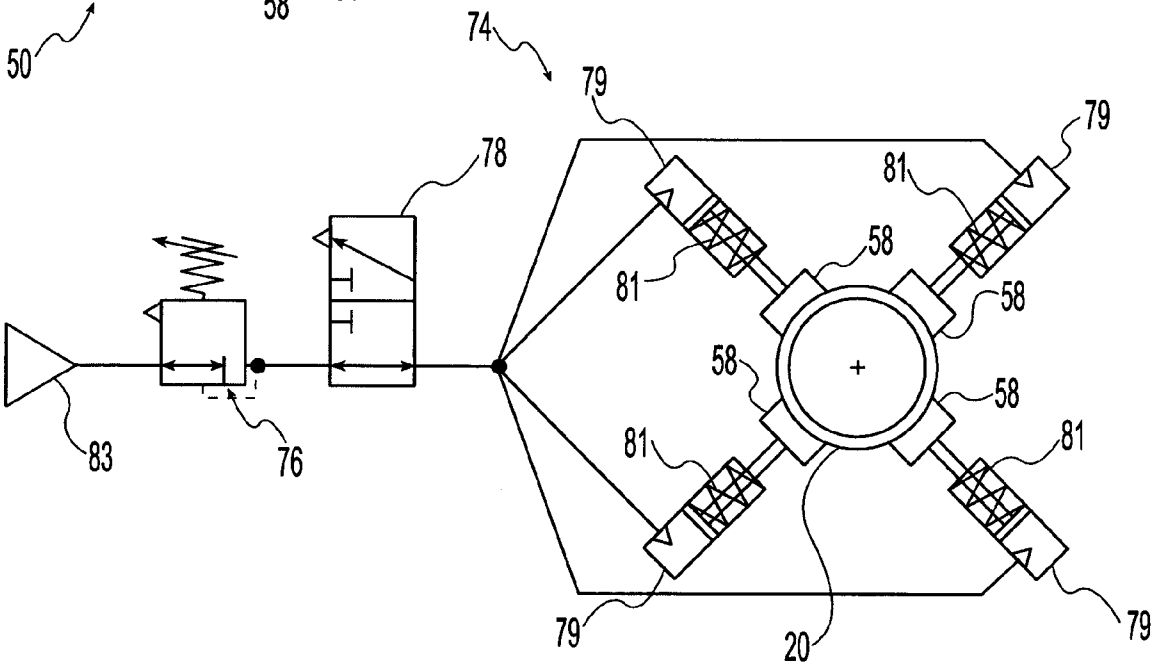
FIG. 10 is a schematic of a further embodiment of the brake assembly according to the present invention.

This design of the clamp 60 enables the application of specific, calibrated forces to the brake shoes 58 which can be readily released, without the use of tools to reset or disassemble the brake assembly 50 without disturbing the calibration. As shown in FIG. 10, a functionally similar system could use a pneumatic system 74 with an adjustable calibrated pressure regulator 76 to apply a specific calibrated force via single acting pneumatic cylinders 79, preferably including return springs 81, and a dump valve 78 to provide a quick-release. A compressed air source 83 is also shown.

As assembled, the plurality of clamp guides 70 may be positioned upon the brake assembly frame 52. The guides 70 may be screwed, welded, secured by adhesive, or otherwise attached to the frame 52. Alternatively, the guides 70 need not be secured or attached to the frame 52. Or, the brake assembly frame 52 itself may be formed to include the clamp guides 70. In yet another embodiment, the clamp guides 70 may be eliminated entirely and the brake shoes 58 formed to include a guide feature to cooperate with the clamp strap 68 to help align the clamp 60. Or, no clamp guides 70 or modified brake shoes 58 may be included. The guide bushings 54 are positioned within the frame 52, or, alternatively, the frame 52 is formed to include the guide bushings 54. The brake shoes 58 are positioned within the frame 52. The at least one clamp 60 is positioned around the frame 52. Following insertion of the firing assembly 24 into the brake assembly 50, the at least one clamp 60 may be tightened by the clamp arm 66.

In use with a remote-controlled robot (not shown), the brake assembly 50 is attached or otherwise secured to a robot arm 100 with the firing assembly 24 inserted within the brake assembly 50. Initially, the firing assembly 24 is in the position shown in FIG. 8A. Following firing, the firing assembly 24 has recoiled to the position shown in FIG. 8B. Thus, as a reaction to a projectile being fired, the firing assembly 24 moves laterally relative to the brake assembly 50 and friction created between the brake shoes 58 and the tube 20 acts to mitigate the recoil of the firing assembly 24. Thus, the energy of the sudden recoil impulse is spread out over a longer period of time, and its maximum force is reduced.

As examples, a firing assembly 24 weighing 12.44 pounds was loaded with 140 milliliters of water which was fired at a velocity of approximately 1,000 feet per second. Using piezoelectric force transducers to measure the force, a braking force of 203 pounds-force resulted in a recoil of 10.7 inches of travel. Similarly, a braking force of 109.3 pounds-force resulted in a recoil of 19.25 inches of travel.

Figures 8A, 8B:
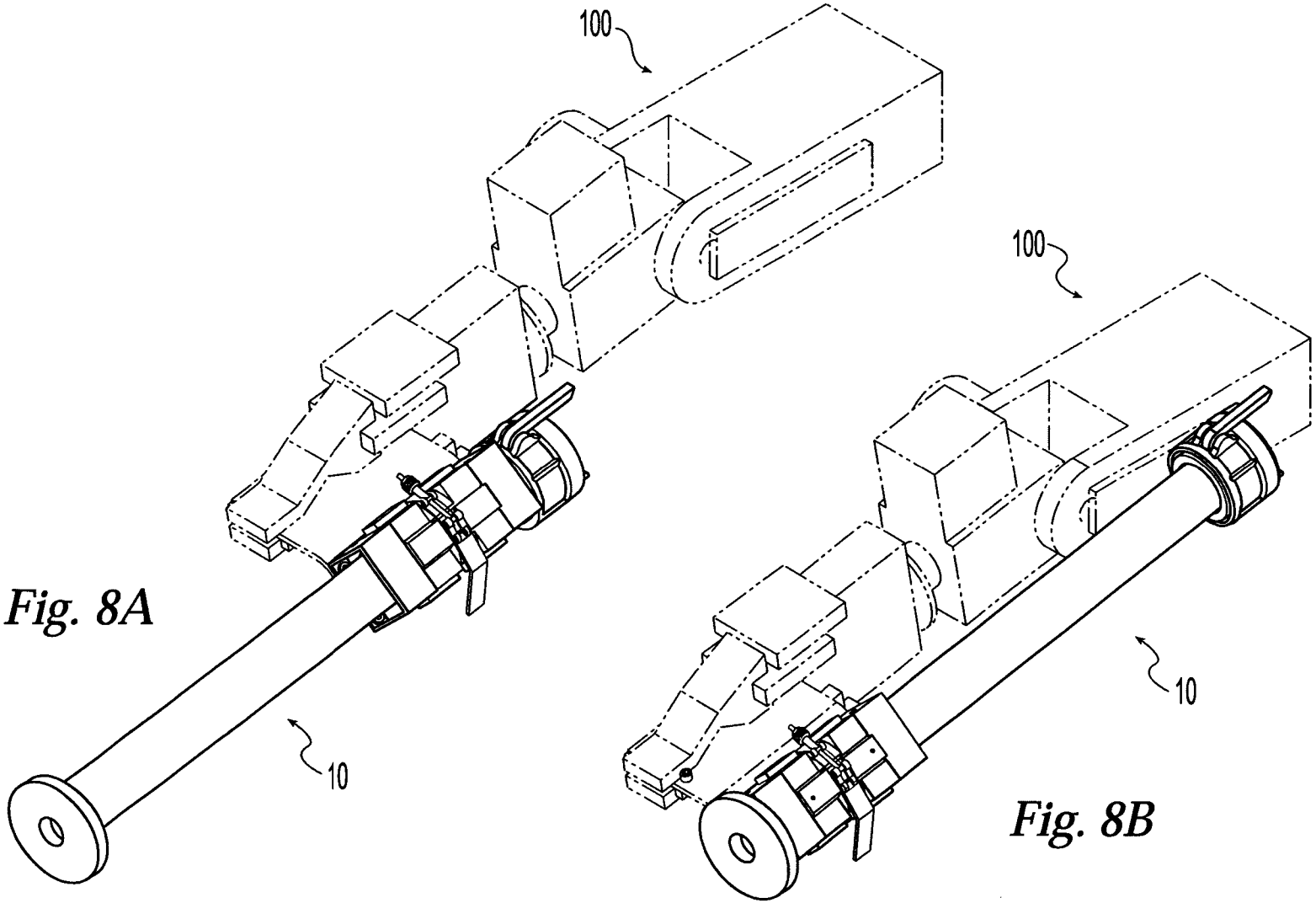
FIG. 8A is a perspective view of the recoil-mitigated projectile-firing device prior to firing.
FIG. 8B is a perspective view of the recoil-mitigated projectile-firing device after firing.

As will be appreciated by one skilled in the art, a higher force is often required to overcome static (before the surfaces are in sliding motion relative to one another) friction than kinetic (once the surfaces are in sliding motion relative to one another) friction. Thus, a larger force peak is generated as this greater frictional resistance is overcome. This larger force peak may be reduced by modifying the outer surface of the tube 20. As shown in FIG. 8A, this may be accomplished with a coating of low-friction material 22, such as polyethylene or other suitable material, on the outer surface of the tube 20 where the brake shoes 58 are initially positioned. When the projectile is fired, the lower force necessary to overcome the static friction between the brake shoes 58 and the outer surface of the tube 20 with a low-friction material reduces the initial static peak. When the area covered with low-friction material moves beyond the brake shoes 58 and the brake shoes 58 begin sliding over the other material of the outer surface of the tube 20, the firing assembly 24 is already moving and little or no additional static peak is produced.

Figure 9:
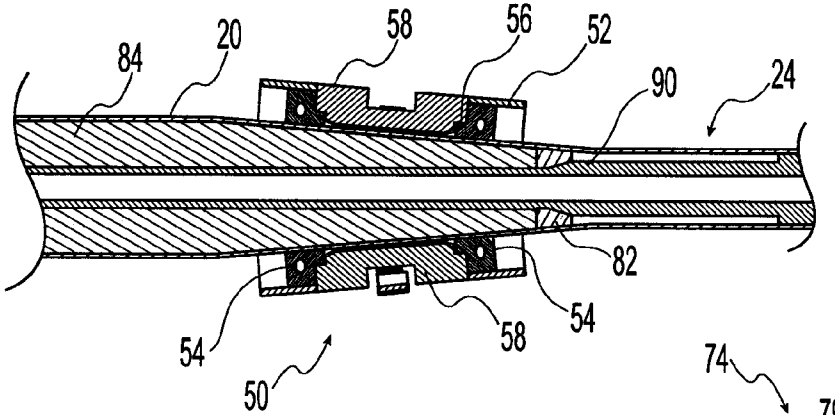
FIG. 9 is a partial cutaway elevation view of the recoil-mitigated projectile-firing device according to another embodiment of the present invention.

Besides changing the friction characteristics of the surface of the tube 20 in the starting position, the tube 20 geometry can be varied as well. As shown in FIG. 9, greatly exaggerated, by tapering or necking down the tube 20 geometry in the starting area, the brake shoes 58 will exert less initial force on the tube 20 so the initial static peak is again reduced. Thus, the friction force will "ramp up".

Although the invention has been described in detail with reference to certain preferred embodiments, variations and modifications exist within the scope and spirit of the invention as described and defined in the following claims.

We claim:

1. A recoil-mitigated projectile-firing device, the device comprising:

a firing assembly, the firing assembly comprising:

a projectile-firing device; and a tube secured about at least a portion of the projectile-firing device; and a brake assembly in frictional contact with the tube, the brake assembly comprising means for urging the brake assembly against the tube, and wherein when the device is fired, a force-time profile of the recoil is substantially constant.

2. The recoil-mitigated projectile-firing device of claim 1, wherein the brake assembly further comprises at least one brake shoe.

3. The recoil-mitigated projectile-firing device of claim 2, wherein the brake assembly further comprises at least one pair of brake shoes.

4. The recoil-mitigated projectile-firing device of claim 3, wherein the urging means comprises at least one clamp.

5. The recoil-mitigated projectile-firing device of claim 3, wherein the urging means comprises at least one pneumatic cylinder.

6. The recoil-mitigated projectile-firing device of claim 4, wherein at least one of the brake shoes is adapted to cooperate with the at least one clamp.

7. The recoil-mitigated projectile-firing device of claim 4, wherein the at least one clamp further comprises compression means.

8. The recoil-mitigated projectile-firing device of claim 7, wherein the compression means is chosen from the group consisting of disc springs and coil springs.

9. The recoil-mitigated projectile-firing device of claim 3, wherein the at least one pair of brake shoes is formed from a resin-bonded inorganic.

10. The recoil-mitigated projectile-firing device of claim 1, wherein the brake assembly further comprises a frame.

11. The recoil-mitigated projectile-firing device of claim 10, wherein the brake assembly further comprises at least one bushing, the at least one bushing adapted to receive the tube.

12. The recoil-mitigated projectile-firing device of claim 11, wherein the number of bushings is two and the bushings are positioned at opposite ends of the frame.

13. The recoil-mitigated projectile-firing device of claim 12, wherein each bushing further comprises a shoulder.

14. The recoil-mitigated projectile-firing device of claim 13, wherein the brake assembly further comprises at least one pair of brake shoes.

15. The recoil-mitigated projectile-firing device of claim 14, wherein the at least one pair of brake shoes further comprises at least one chamfer adapted to cooperate with a bushing shoulder.

16. The recoil-mitigated projectile-firing device of claim 15, wherein the urging means comprises at least one clamp.

17. The recoil-mitigated projectile-firing device of claim 16, wherein at least one of the brake shoes is adapted to cooperate with the at least one clamp.

18. The recoil-mitigated projectile-firing device of claim 1, wherein the firing assembly further comprises at least one bushing interposed in an annular space between the projectile-firing device and the tube.

19. The recoil-mitigated projectile-firing device of claim 1, wherein the firing assembly further comprises a sleeve interposed in an annular space between the projectile-firing device and the tube.

20. The recoil-mitigated projectile-firing device of claim 1, wherein the firing assembly further comprises an end stop secured to one end of the tube.

21. The recoil-mitigated projectile-firing device of claim 1, wherein the firing assembly further comprises an end closure adapter and an end closure, the end closure adapted to be secured to the end closure adapter.

22. The recoil-mitigated projectile-firing device of claim 21, wherein the firing assembly further comprises a cushion interposed between the end closure and a breech end of the projectile-firing device.

23. The recoil-mitigated projectile-firing device of claim 22, wherein the firing assembly further comprises a gasket interposed in an annular space between the cushion and the end closure.

24. A recoil-mitigated projectile-firing device, the device comprising:

a firing assembly, the firing assembly comprising:

a projectile-firing device; and a tube secured about at least a portion of the projectile-firing device, the tube being tapered over at least a portion of its length; and a brake assembly in frictional contact with the tube, the brake assembly comprising means for urging the brake assembly against the tube.

25. A recoil-mitigated projectile-firing device, the device comprising a projectile-firing device and a brake assembly in frictional contact with the projectile-firing device, the brake assembly comprising means for urging the brake assembly against the projectile-firing device, and wherein when the device is fired, a force-time profile of the recoil is substantially constant.

26. A method of mitigating the recoil of a projectile-firing device, the method comprising the steps of:

(a) placing the projectile-firing device in frictional contact with at least one brake shoe;

(b) urging the at least one brake shoe against the projectile-firing device; and (c) firing the projectile-firing device, whereby the friction between the at least one brake shoe and the projectile-firing device mitigates the recoil of the projectile-firing device, and wherein when the device is fired, a force-time profile of the recoil is substantially constant.

27. A method of mitigating the recoil of a projectile-firing device, the method comprising the steps of:

(a) securing the projectile-firing device within a tube;

(b) positioning the projectile-firing device within the tube with at least one bushing;

(c) enclosing one end of the tube with an end enclosure;

(d) positioning at least one pair of brake shoes in frictional contact with the tube;

(e) urging the at least one pair of brake shoes against the tube; and (f) firing the projectile-firing device, whereby the friction between the at least one pair of brake shoes and the tube mitigates the recoil of the projectile-firing device, and wherein when the device is fired, a force-time profile of the recoil is substantially constant.

28. A brake assembly for braking the motion of an object, the brake assembly comprising:

a frame;

at least one brake shoe, the at least one brake shoe cooperating with the frame;

means for urging the at least one brake shoe against the object; and at least one bushing contained within the frame, the at least one bushing adapted to cooperate with the object, and wherein when the device is fired, a force-time profile of the recoil is substantially constant.

29. The brake assembly of claim 28, wherein the urging means comprises a clamp.

30. The brake assembly of claim 29, wherein the clamp further comprises compression means.

31. The brake assembly of claim 29, the at least one brake shoe formed to cooperate with the clamp.

32. A recoil-mitigated projectile-firing device, the device comprising:

a firing assembly, the firing assembly comprising:

a tube;

a projectile-firing device positioned within the tube, the tube and the projectile-firing device defining a substantially annular space therebetween;

a first substantially annular bushing interposed between the tube and the projectile-firing device in the substantially annular space;

a second substantially annular bushing interposed between the tube and the projectile-firing device in the substantially annular space;

a substantially annular sleeve interposed between the tube and the projectile-firing device in the substantially annular space and positioned around the projectile-firing device between the first annular bushing and the second annular bushing;

an end cap secured to the end of the tube nearest the breech; and a brake assembly, the brake assembly coaxially surrounding a portion of the tube, the brake assembly comprising:

a frame, the frame formed to include one pair of apertures in an axial direction and at least one pair of apertures in a radial direction;

two end bushings, each end bushing formed to include a shoulder, each end bushing secured within each of the one pair of axial frame apertures such that the shoulder of one end bushing lies in a facing and spaced-apart relationship to the shoulder of the other end bushing, each end bushing further slidingly positioned around the tube;

at least one pair of brake shoes, each brake shoe formed to include a chamfer at each end and at least one notch, each brake shoe positioned within each of the at least one pair of radial frame apertures such that each brake shoe chamfer lies in a spaced-apart relationship to the shoulder of one end bushing;

one or more clamp guides, each clamp guide formed to include at least one notch;

a clamp, the clamp positioned around the frame whereby, when the clamp is closed, the clamp is aligned within the notches of the at least one pair of brake shoes and within the notches of the one or more clamp guides.

33. A brake assembly, the brake assembly coaxially surrounding a portion of an object to be braked, the brake assembly comprising:

a frame, the frame formed to include one pair of apertures in an axial direction and at least one pair of apertures in a radial direction;

two end bushings, each end bushing formed to include a shoulder, each end bushing secured within each of the one pair of axial frame apertures such that the shoulder of one end bushing lies in a facing and spaced-apart relationship to the shoulder of the other end bushing, each end bushing further slidingly positioned around the object;

at least one pair of brake shoes, each brake shoe formed to include a chamfer at each end and at least one notch, each brake shoe positioned within each of the at least one pair of radial frame apertures such that each brake shoe chamfer lies in a spaced-apart relationship to the shoulder of one end bushing;

one or more clamp guides, each clamp guide formed to include at least one notch;

a clamp, the clamp positioned around the frame whereby, when the clamp is closed, the clamp is aligned within the notches of the at least one pair of brake shoes and within the notches of the one or more clamp guides.

* * * * *